US006338262B1

(12) United States Patent
Donini et al.

(10) Patent No.: US 6,338,262 B1
(45) Date of Patent: Jan. 15, 2002

(54) METHOD FOR THE STATIC AND DYNAMIC CONTROL OF THE PLANARITY OF FLAT ROLLED PRODUCTS

(75) Inventors: Estore Donini, Vimercate; Paolo Bobig, San Canzian Diisonzo; Cesare Galletti, Segrate S. Felice, all of (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 09/620,583

(22) Filed: Jul. 20, 2000

(30) Foreign Application Priority Data

Jul. 20, 2000 (IT) ..... UD99A0135

(51) Int. Cl.[7] ..... B21B 37/28

(52) U.S. Cl. ..... 72/11.7; 72/9.1; 72/241.8; 72/247; 72/366.2

(58) Field of Search ..... 72/9.1, 11.7, 241.2, 72/241.4, 241.8, 247, 365.2, 366.2

(56) References Cited

U.S. PATENT DOCUMENTS

| | | | | |
|---|---|---|---|---|
| 4,726,213 A | | 2/1988 | Tetsuo | |
| 5,174,144 A | | 12/1992 | Kajiwara et al. | |
| 5,231,858 A | * | 8/1993 | Yanashita et al. | 72/247 |
| 5,592,846 A | * | 1/1997 | Watanabe et al. | 72/241.8 |
| 5,893,313 A | | 11/1998 | Ginzburg | |
| 5,875,663 A | * | 3/1999 | Tateno et al. | 72/247 |
| 5,924,319 A | | 7/1999 | Ginzburg | |
| 5,950,478 A | | 9/1999 | Sato et al. | |
| 6,158,260 A | * | 12/2000 | Ginzburg | 72/9.2 |

FOREIGN PATENT DOCUMENTS

JP 63002507 7/1988

OTHER PUBLICATIONS

Patent Abstract of Japan, vol. 012, No. 195 (M–705) Jun. 7, 1988 & JP 63 002507 A Nippon Steel Jan. 1988.

"Modernisierung der Kaltwalzanlage Bei Der Krupp–VDM GmbH" vol. 116, No. 5, May 10, 1996 pp. 101–104, 152, Stahl und Eisen, De, Verlag Stahleisen GmbH, p. 102, right col.

Patent Abstracts of Japan, vol. 012, No. 091 (M–679) Mar. 24, 1988 & JP 62 230412 Sumitomo Metal Ind. Ltd., Oct. 9, 1987.

Development of Accurate Control Techniques Of Strip Shape and Edge–Drop in Cold Rolling, Yamamoto, Journal of The Iron And Steel Institute Of Japan, vol. 79, No. 3, Jan. 1, 1993 pp. 388–394.

Patent Abstracts of Japan, vol. 015 No. 294 (M–1140) Jul. 25, 1991 & JP 03 106507 Sumitomo Metal Ind. Ltd, May 7, 1991.

* cited by examiner

*Primary Examiner*—Ed Tolan
(74) *Attorney, Agent, or Firm*—Antonelli, Terry, Stout & Kraus, LLP

(57) ABSTRACT

Method to control the planarity of flat products rolled with a rolling stand (10) having a pair of working rolls (11*a*, 11*b*), a corresponding pair of back-up rolls (13*a*, 13*b*) and at least an intermediate roll (15*a*) placed between one of said working rolls (11*a*) and a corresponding back-up roll (13*b*), axial translation means (16) and first bending means (17) associated with at least one of said working rolls (11*a*) to translate it axially (WR shifting) and respectively bend it (WR bending), crossing means (19) associated with said intermediate roll (15*a*) to arrange it with its longitudinal axis (25*a*) inclined (IR crossing), that is, rotated on a horizontal plane, with respect to the longitudinal axes (21*a*, 21*b*, 23*a*, 23*b*) of said working rolls (11*a*, 11*b*) and of said back-up rolls (13*a*, 13*b*), and second bending means (20) associated with said intermediate roll (15*a*) to bend it with respect to the horizontal plane (IR bending), said method providing a first static setting step, operating selectively at least on WR shifting and on IR crossing, and at least a second dynamic setting step, that is to say, during rolling, operating selectively at least on WR bending and IR bending.

9 Claims, 8 Drawing Sheets

METHOD FOR THE STATIC AND DYNAMIC CONTROL OF THE PLANARITY OF FLAT ROLLED PRODUCTS

FIELD OF THE INVENTION

This invention concerns a method for the static and dynamic control of the planarity of flat rolled products, such as strip or similar. The method is advantageously applied in five- or six-high stands, having a pair of working rolls (WR) associated with both negative and positive bending mechanisms and axial displacement, or shifting, mechanisms, a pair of back-up rolls (BUR), and at least an intermediate roll (IR) associated with a crossing mechanism and a positive and negative bending mechanism.

The method to control planarity provides that the second order components, the fourth order components and the edge-drop of the profile of the rolled strip are controlled independently. This control may occur both statically, (that is, during the initial setting or preset of the rolling mill, to set up the stand before rolling starts, to take it to adequate working conditions) and also dynamically, during rolling. To be more exact, the second order and fourth order components can be dynamically controlled, and even controlled with great efficiency.

BACKGROUND OF THE INVENTION

The state of the art includes a method to control the planarity of flat rolled products in six-high rolling stands, wherein both the working rolls and the intermediate rolls are associated both with bending systems, both negative and positive, and also with a system of long axial translation or shifting (macro shifting).

This method of control, however, has the disadvantage that it cannot completely and efficiently compensate edge-drop, and requires a particularly long axial translation of the intermediate rolls.

Another disadvantage of this method, which provides for the shifting of the intermediate rolls, is that the speed at which the shifting is performed is extremely slow compared with the rolling speed, that is to say, about 1/1000 of the latter. Therefore, if the setting of the stand is not correct, since the inlet profile of the product being rolled is different from the final profile, or the rolling force is different from the initial expected one, there is a delay in the re-setting of the stand, for example because of the speed of shifting, with a resulting loss of planarity for a length of strip which is equal to the time taken to reset the stand multiplied by the rolling speed.

To at least partly solve this problem of compensating the edges, various rolling stands and control systems have already been proposed which provide a system of axial translation of the working rolls in the same direction as the intermediate rolls and wherein the working rolls are equipped with appropriate bevels or hollows at the ends.

Moreover, the state of the art also includes a rolling method wherein the intermediate rolls (IR) are associated with crossing means suitable to reduce the so-called "strip walking".

The present Applicant has devised, designed and perfected the method to control the planarity of rolled products according to the invention to overcome the shortcomings described above and to improve the methods known in the state of the art.

SUMMARY OF THE INVENTION

One purpose of the invention is to achieve a method for the static and dynamic control of the planarity of flat rolled products, such as strip or similar, which will make possible to control and adjust, autonomously and independently, both statically and dynamically, that is to say, during rolling, both the $x^2$ component and the $x^4$ component, but also components of a higher order, which consequently makes it possible to control the edge-drop of the rolled product, that is to say, components up to $x^{10}$.

In accordance with this purpose, the method for the static and dynamic control of the planarity of flat rolled products according to the invention comprises a pair of working rolls, a corresponding pair of back-up rolls and at least an intermediate roll located between one of the working rolls and a corresponding back-up roll, shifting means and bending means associated with at least one of the working rolls to translate it axially and respectively bend it, and crossing and bending means associated with the intermediate roll to arrange it with its longitudinal axis inclined, or rotated, with respect to the longitudinal axes of the working rolls and the back-up rolls and respectively bend it.

Before describing the invention in detail, it is appropriate to make the following premises:

The ability to control the profile of the strip being rolled is generally shown in the plane $x^2$, $x^4$ (FIG. 5), where $x^2$ and $x^4$ are the second and fourth order components of the function $y(x)=a_0+a_1x+a_2x^2+a_3x^3+\ldots+a_{10}x^{10}$, which represents the thickness of the strip (FIG. 6).

If the thickness is symmetrical, as it should be, the odd components should not be present. At most, we might find the component $a_1x$ which indicates the presence of strip with a wedge defect, that is, a profile which is on average trapezoid with edges of a different thickness, as shown in FIG. 7.

The more efficient a stand is at controlling the shape, the wider is the zone $x^2$, $x^4$ which can be controlled; FIG. 8 shows two areas, the most extensive of which refers to a system with a higher control capacity than the more inward area.

If a stand has high dynamic performance in controlling the shape of the strip, this means that it is possible to pass quickly from a point A (FIG. 9) to a point B in the plane $x^2$, $x^4$. Then, together with an area of "static" or preset control, an area of "dynamic" control is also shown, clearly included in the area of static control which moves inside the area of global control (FIG. 10) according to the initial static functioning point "0".

Since every actuator suitable to control the movements of the working rolls and intermediate rolls, in every operating condition (that is, roll diameters, strip width, inlet profile, rolling force, etc.) has its own "line of action", to pass with complete freedom from a point A to a point B, it is generally necessary to have two actuators AT1 and AT2 which move in their own directions d1 and respectively d2 (FIG. 11). Therefore, in the field of dynamic control, to have the possibility to pass from A to B without constraints on position B, the two necessary actuators must also have lines of action which are not parallel.

This having been said, FIG. 12 shows the control of the crossing of an intermediate roll (IR) according to the invention, wherein it can be noticed how the influence of $x^2$ has limited collateral effects on $x^4$, since the ratio between $x^2$ and $x^4$ is about 1/10. Therefore, by acting on IR crossing we have very limited effects on the $x^4$ component.

From the detail shown in FIG. 13, in which the two working rolls (WR) are shown, it can be seen how WR shifting prevalently influences the edges of the strip, if the working roll is appropriately bevelled.

WR shifting influences both $x^2$ and $x^4$ but in a very limited way compared with WR bending, IR crossing and IR bending. WR shifting is practically defined by the width of the strip, with very small adjustments according to the actual edge-drop on the strip at outlet. The ratio between $x^2$ and $x^4$ is about 1.

As can be seen in FIG. 14, WR bending influences both $x^2$ and $x^4$. The ratio $x^4/x^2$ depends on the choice of the diameters of the rolls of the stand and on the width of the strip (rolling force, etc.), and is in any case near 1.

In FIG. 15 it can be seen how IR bending prevalently influences $x^2$ with collateral effects on $x^4$ (as for IR crossing), even though the action is less efficacious than that obtained with IR crossing. The $x^4/x^2$ ratio is about 1/10.

The influence of IR crossing, IR bending, WR bending on the edges of the strip is very limited, and therefore when IR crossing, IR bending and WR bending is varied, it is not necessary to modify the set of WR shifting.

Therefore, the rolling stand which adopts the method according to the invention is equipped with means which allow IR crossing, IR bending, WR shifting and WR bending.

To be more exact, WR shifting is used to pre-set the working rolls according to the edge-drop. This constitutes a "static" actuator which does not influence the field of control $x^2/x^4$ since it is constrained only to the desired edge-drop correction.

IR crossing is used to pre-set the IR to obtain a desired $x^2$ component. IR crossing is obtained by means of a preset actuator which can however be used in rolling too, to change the $x^2$ component if the other actuators which control $x^2$ dynamically (that is, WR bending and IR bending) are near saturation.

WR bending and IR bending are dynamic controllers and generally have to act simultaneously if it is desired to correct a $x^2$, $x^4$ defect during rolling (FIG. 16). Moreover, WR bending and IR bending must have the same dynamic performance, with reply times of less than tenths of a second, and have to act simultaneously. See for example the graphs in FIG. 17 and FIG. 18, which show a dynamic compensation $x^2$ and respectively a dynamic compensation $x^4$. For this reason, both WR bending and IR bending must be able to be both positive and negative.

With respect to a conventional rolling stand, or equipped with WR bending, IR bending and IR shifting, it is appropriate to make the following considerations.

IR shifting, as in conventional stands, practically has an influence only on $x^2$ (the $x^4/x^2$ ratio is equal to about 1/15), and has an action of $x^2$ variation reduced by about 3–4 times compared with those of IR crossing. The comparison is between IR shifting with a travel of 200 mm and IR crossing with a rotation of 0–1.5°. Therefore IR crossing is much more efficient.

Moreover, IR shifting, where it is included, is variable in rolling, with shifting speeds of 1/1000 of rolling speeds to prevent damage to the surfaces of the rolls. With a rolling speed of 20 m/sec we have a shifting speed of 20 mm/sec. Therefore, it would take 10 secs to carry out the whole control travel.

The IR crossing speed is higher, at about 0.1°/sec. Consequently, to have the same $x^2$ variation corresponding to the whole shifting travel (in the embodiment which includes IR shifting), it is enough to vary the crossing angle by 0.2–0.6°, according to the starting point (FIG. 19).

Moreover, crossing is quicker: 0.2–0.6° are varied in 2–6 secs, whereas with IR shifting it needs at least 10 secs to carry out the whole travel and obtain the same effects on the strip.

Thanks to the high control capacity of IR crossing, which as we have seen is on average about three times more than that of IR shifting in conventional stands, it is possible to use IR crossing also in a five-high stand, keeping high the capacity to control the profile of the strip.

According to a preferential embodiment of the invention, a pair of intermediate rolls is located between the pair of working rolls and the pair of back-up rolls, therefore the rolling stand is the six-high type.

According to a simplified variant, only one intermediate roll is arranged in the upper section between a corresponding working roll and a corresponding back-up roll, therefore the stand is of the five-high type.

According to one characteristic of the invention, the bending of each working roll and intermediate roll can be both positive and negative.

According to another characteristic of the invention, the working rolls are provided, at least at one end, with bevels appropriately configured so as to control the profile of the edges of the rolled product.

According to another characteristic of the invention, the crossing mechanism allows to carry out the crossing of each intermediate roll quickly, during the rolling step, since the maximum rotation of the intermediate rolls, compared with the working rolls, is about 1.5° and since the speed of rotation is about 0.1°/sec, the correction operation, which requires to vary the angle by 0.2–0.6°, is carried out in about 2–6 secs.

According to another characteristic of the invention, the method to control the planarity of flat products provides a step of monitoring, by sensor means, the profile of the product emerging from the stand, and a step of acting on shifting means and bending means associated with at least one of the working rolls to translate it axially and respectively bend it, on crossing means and bending means associated with the intermediate roll to arrange it with its longitudinal axis inclined, or rotated with respect to the longitudinal axes of the working rolls and the back-up rolls and respectively bend it.

With reference to FIG. 20, in which "0" indicates the work point which represents the profile of the strip with all the actuators in the inactive position, or initial position, and "F" indicates the point which represents the strip profile desired, it should be remembered that to obtain the desired profile it is necessary, according to the invention, to make the following operations:

Set WR shifting to suitably correct the edge profile ("edge-drop compensation"); from point "0" we pass to an intermediate point "1";

Set IR crossing to modify the $x^2$ component in preset mode;

Act dynamically on IR bending and WR bending to move on the $x^2$, $x^4$ plane and reach the required "F" point.

Where the use of IR bending and WR bending is not enough to reach point "F", activate IR crossing dynamically to quickly reach the desired performance.

BRIEF DESCRIPTION OF DRAWINGS

These and other characteristics of the invention will become clear from the following description of a preferred form of embodiment, given as a non-restrictive example, with reference to the attached drawings wherein.

DETAILED DESCRIPTION OF PREFERRED EMBODIMENT

Figure 1:
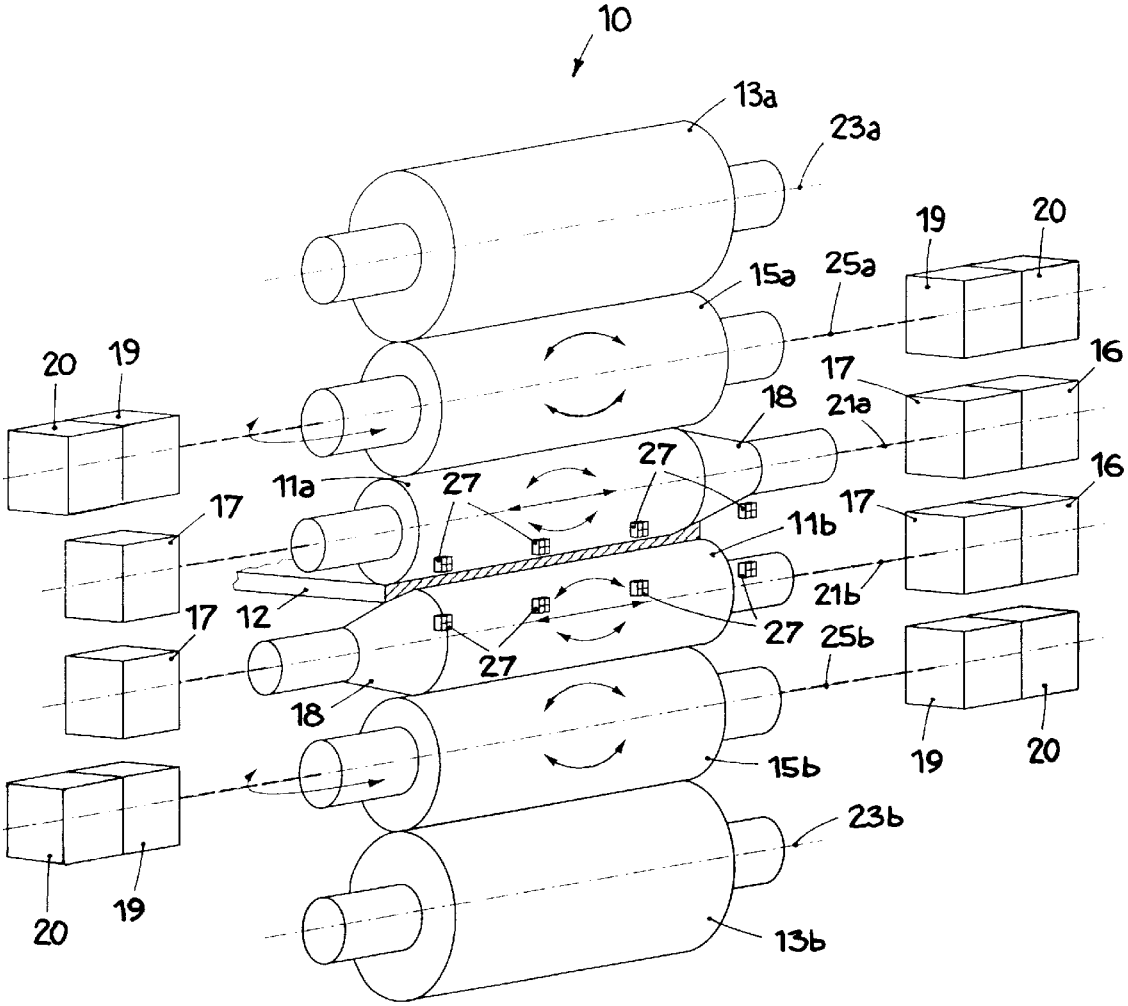
FIG. 1 is a schematic view of a six-high rolling stand suitable to adopt a method according to the invention.

With reference to FIGS. 1–4, a rolling stand 10 suitable to adopt a method according to the invention comprises a pair of working rolls 11*a*, 11*b* between which the flat product 12 to be rolled, consisting for example of strip, is suitable to pass.

Associated with the two working rolls 11*a*, 11*b*, two corresponding back-up rolls 13*a*, 13*b* are provided, suitable to contrast the thrust due to the rolling of the product 12.

The rolling stand 10, according to a first form of embodiment, is of the so-called six-high type, and comprises a pair of intermediate rolls 15*a*, 15*b*, located between the working rolls 11*a*, 11*b* and the back-up rolls 13*a*, 13*b*.

Associated with at least one working roll 11*a* or 11*b*, but advantageously with both, an axial translation mechanism 16, or shifting mechanism, is provided, of a conventional type and not shown in detail in the drawings. The mechanism 16 is suitable to displace the corresponding working roll 11*a*, 11*b* along the horizontal plane on which its longitudinal axis 21*a*, 21*b* lies, thus achieving an axial translation of one working roll 11*a* with respect to the other 11*b*.

Moreover, associated with at least one working roll 11*a* or 11*b*, but advantageously with both, there is also provided a bending mechanism 17, of a conventional type and not shown in detail in the drawings. The mechanism 17 is suitable to bend the corresponding working roll 11*a*, 11*b* in both directions with respect to the horizontal plane on which its longitudinal axis 21*a*, 21*b* lies in the inactive condition, and thus obtain a controlled bending both positive and negative.

The working rolls 11*a*, 11*b* are also provided, at least at one end, with bevels 18 suitably configured to control the profile of the edges of the rolled product 12.

The intermediate rolls 15*a*, 15*b* are associated with a crossing mechanism 19, of a conventional type and not shown in detail in the drawings. The mechanism 19 is suitable to incline the intermediate rolls 15*a*, 15*b* around a vertical axis 26 (FIG. 3) by a desired angle $\alpha$ in both directions with respect to the working rolls 11*a*, 11*b* and back-up rolls 13*a*, 13*b*, maintaining their longitudinal axes 23*a*, 23*b* on the same horizontal plane PIR parallel to the rolling plane on which the rolled product 12 lies Each intermediate roll 15*a*, 15*b* is also associated with a bending mechanism 20 (FIGS. 1 and 2), of a conventional type and not shown in detail in the drawings. The mechanism 20 is suitable to bend the corresponding intermediate roll in both directions with respect to the horizontal plane PIR on which their longitudinal axis 25*a*, 25*b* lie in the inactive condition, and thus obtain a controlled bending both positive and negative.

Sensor means 27, of a conventional type and not shown in detail in the drawings, are provided near the working rolls 11*a*, 11*b* to monitor the profile of the rolled product 12.

No shifting mechanism is associated with the intermediate rolls 15*a*, 15*b*.

No device to control and/or modify their position or their profiles is associated with the back-up rolls 13*a*, 13*b*, and therefore their longitudinal axes 23*a*, 23*b* are subject to remain in their nominal position.

The double effect bending (positive and negative) achieved by the bending mechanism 17 on the working rolls 11*a*, 11*b* is sufficient to allow the fourth order components ($x^4$) to be controlled. The long shifting of the working rolls 11*a*, 11*b* achieved by the mechanism 16 allows to control the edge-drop of the rolled product 12.

The crossing mechanism 19, moreover, allows to carry out the crossing of the intermediate rolls 15*a*, 15*b* during the rolling process in a rapid fashion, considering that the maximum rotation of the intermediate rolls 15*a*, 15*b* compared with the working rolls 11*a*, 11*b* is about 1.5° and that the speed of rotation is in the order of 0.1°/sec.

Figure 20:
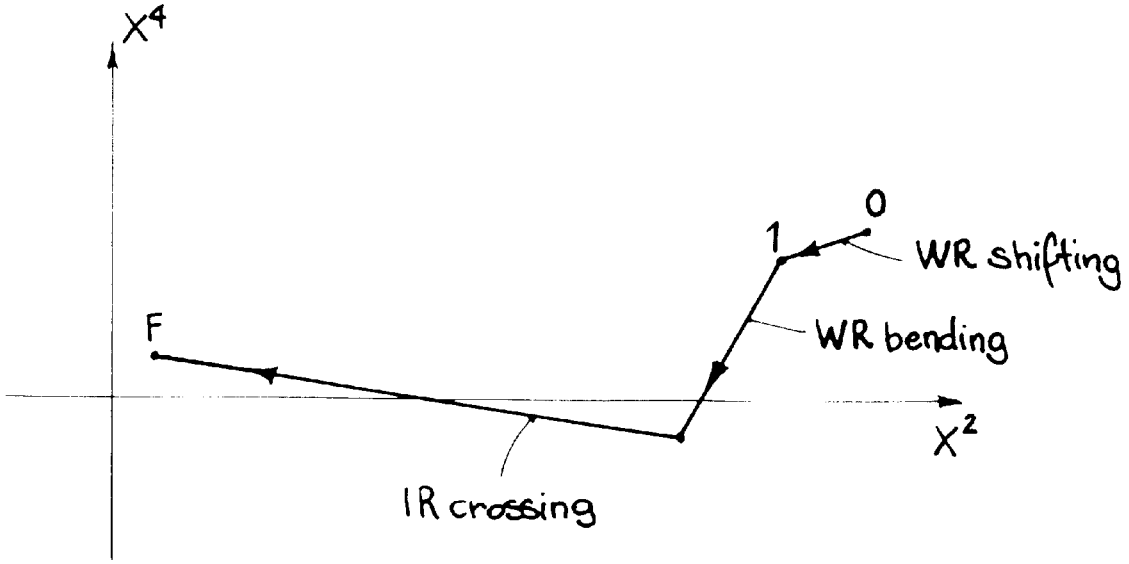
Figure 21:
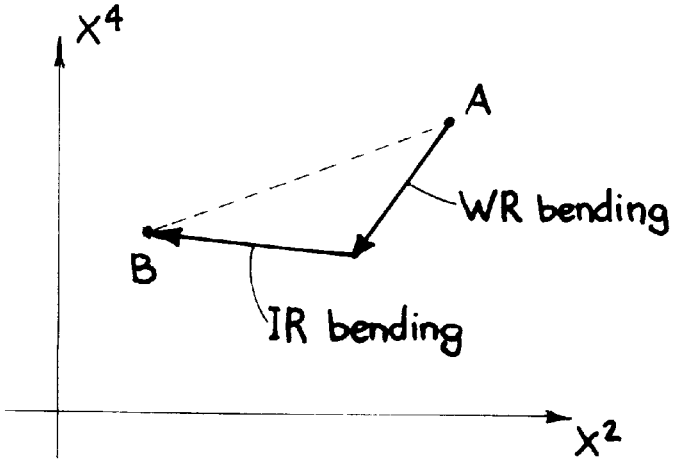

According to one characteristic of the invention, IR bending is used in combination with WR bending to be able to vary, in a completely free manner, the $x^2$, $x^4$ components dynamically, as can be understood from FIGS. 20 and 21.

The method to control the planarity of rolled products 12 provides to monitor, by means of sensors 27, the profile of the rolled product 12 emerging from the stand 10, and to act on the mechanisms 16, 17, 19 and 20 to modify the axial setting and/or the profile (curvature) of the working rolls 11*a*, 11*b*, and also the crossing and bending of the intermediate rolls 15*a*, 15*b* with respect to the working rolls 11*a*, 11*b*.

With the stand 10 and the method as described heretofore, it is possible to achieve a better control of the rolling process, compared with the state of the art, thanks to the fact that it is possible to use and control multiple functions in an independent and co-ordinated manner; in fact, by crossing and bending the intermediate rolls 15*a*, 15*b* it is mainly the second order components that are controlled, by bending the working rolls 11*a*, 11*b* the fourth order components are controlled, with an effect on the second order components too, and by shifting the working rolls 11*a*, 11*b* the edge-drop is controlled.

FIGS. 12, 14, 15–18 and 20 show the behaviour of the mechanisms 16, 17, 19 and 20, to achieve respectively WR shifting (16), WR bending (17), IR crossing (19) and IR bending (20).

WR shifting (FIG. 14) is carried out to obtain a correction of edge-drop, and has little effect on both $x^2$ and on $x^4$; it is used substantially to preset the stand 10, together with IR crossing and WR bending.

IR crossing (FIGS. 12, 15 and 20) is carried out to substantially modify $x^2$ and has little effect on $x^4$; as we have seen, it is used to preset the stand 10, together with IR crossing and WR bending. It can also be used dynamically if IR bending is near saturation or at its limit.

WR bending (FIGS. 14, 16–18 and 20) is carried out substantially to modify $x^4$ even though it also effects $x^2$; as we have seen, it is used to preset the stand 10, together with WR shifting and IR crossing. It is used dynamically with IR bending.

IR bending (FIGS. 15–18) is carried out substantially to modify $x^2$ and has little effect on $x^4$; it is used dynamically with WR bending.

For the preset static adjustment of the stand 10 (FIG. 20) we act on WR shifting, WR bending and IR crossing, thus modifying the setting of the stand 10 and taking it from its initial inactive condition "0", to the value "F", wherein the $x^2$ and $x^4$ components have the desired value.

For dynamic adjustment, that is, when rolling is taking place, we act simultaneously on WR bending and IR bending (FIG. 21).

If IR bending and WR bending are near saturation or at the upper or lower limit, we can act on IR crossing to return to a full capacity of dynamic control.

To be more exact, IR crossing is set to modify the $x^2$ component in preset.

Then, we act dynamically on IR bending and WR bending to move on the $x^2$, $x^4$ plane and reach the required "F" point.

When the use of IR bending and WR bending is not sufficient to reach point "F", IR crossing is activated dynamically to reach the required performance quickly.

Figure 2:
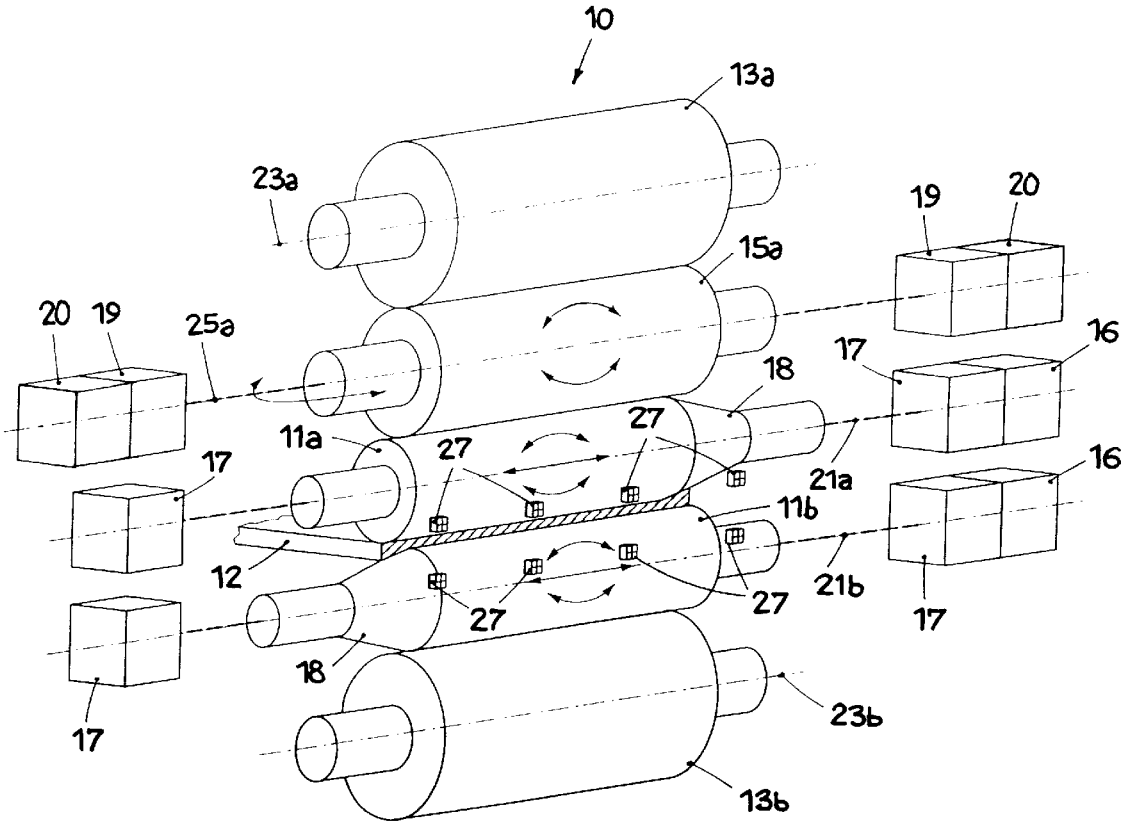
FIG. 2 is a schematic view of a five-high rolling stand suitable to adopt a method according to the invention.
Figure 3:
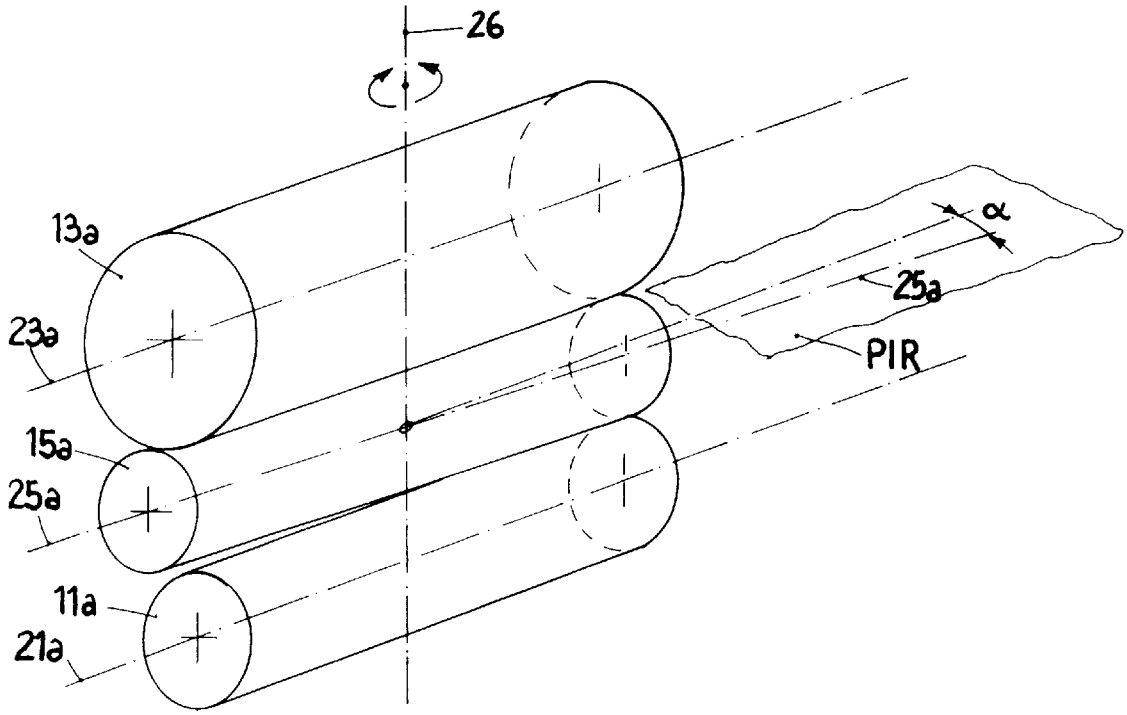
FIG. 3 is a schematic, prospective view of the upper part of the rolling stand as in FIG. 1.
Figure 4:
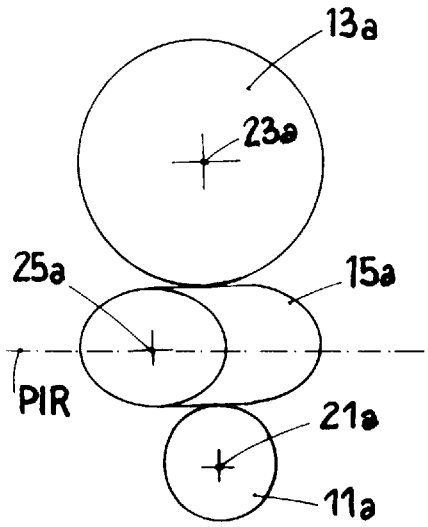
FIG. 4 is a schematic, side view of the upper part of the rolling stand as in FIG. 1.
Figure 5:
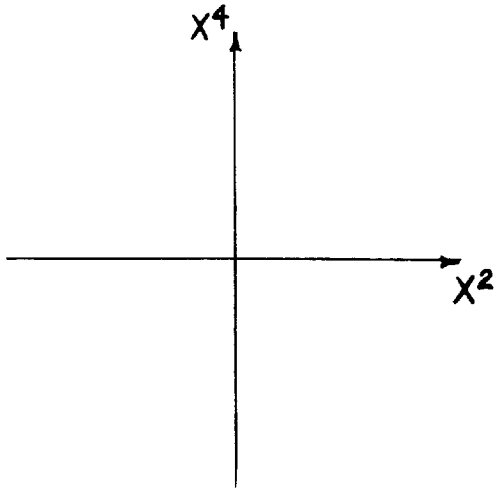
FIGS. 5–21 are graphic representations of the behaviour of the rolled strip and the components of the second and fourth order, in a rolling stand.
Figure 6:
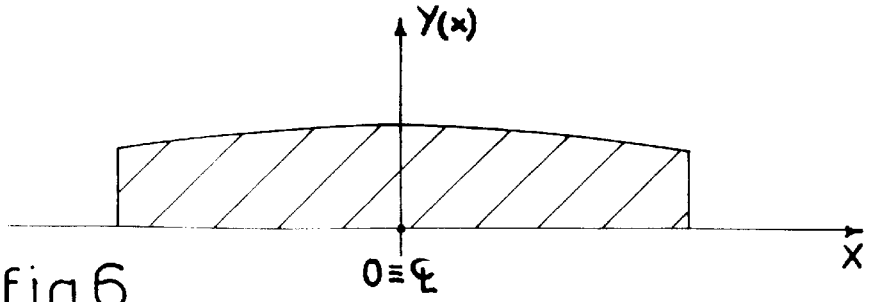
Figure 7:
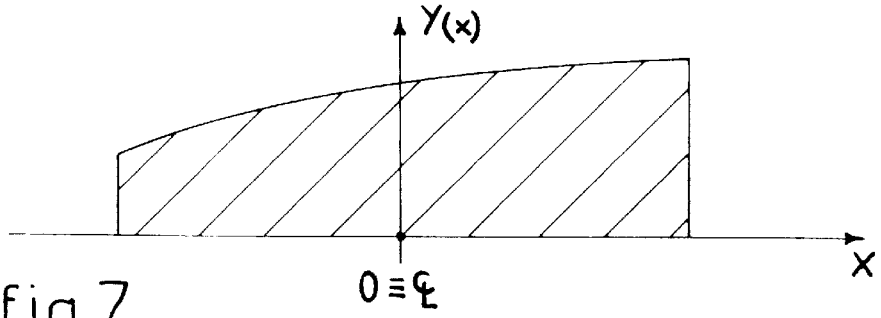
Figure 8:
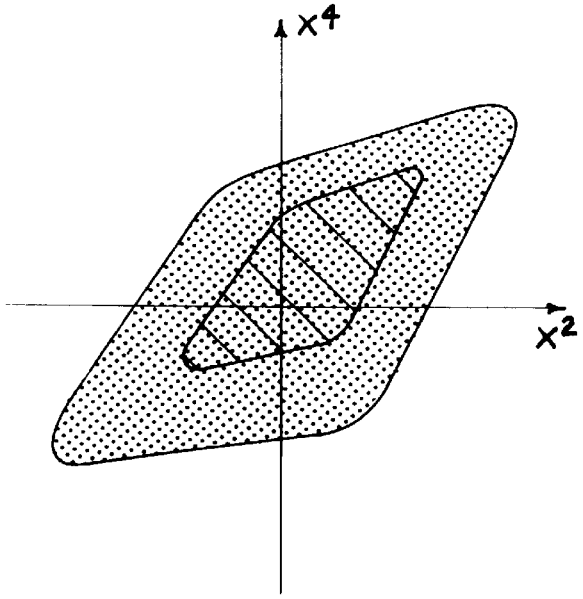
Figure 9:
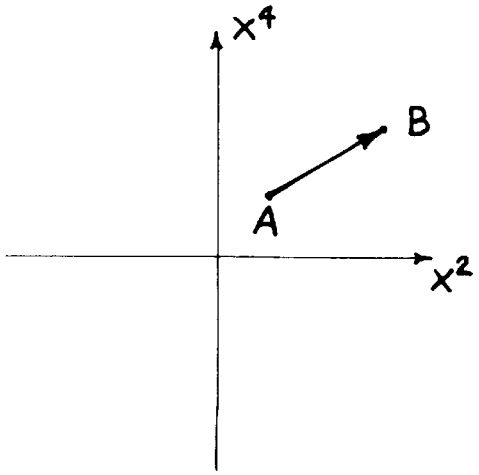
Figure 10:
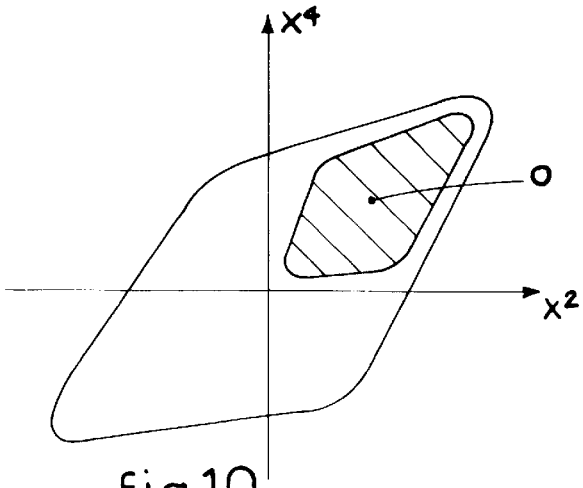
Figure 11:
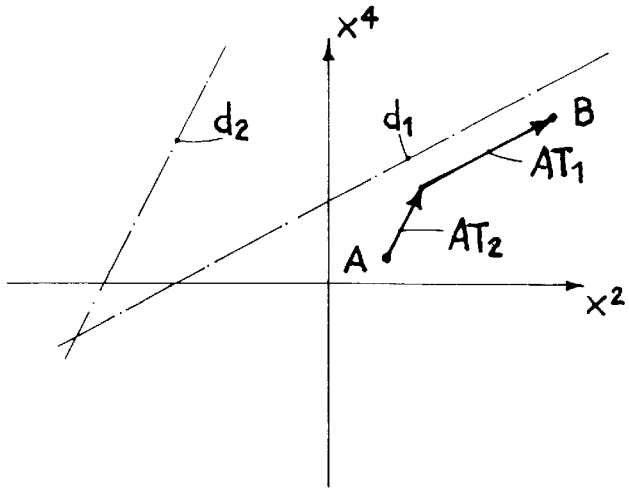
Figure 12:
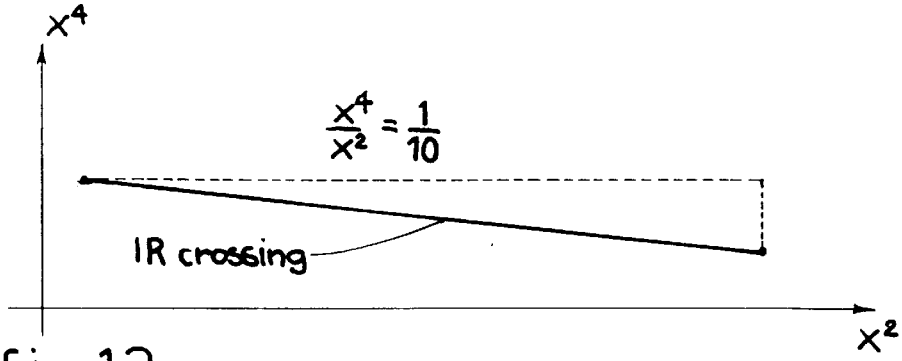
Figure 13:
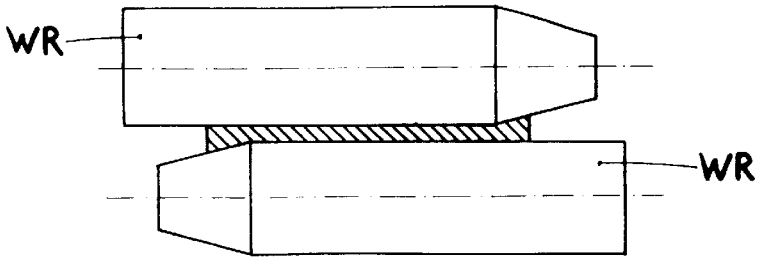
Figure 14:
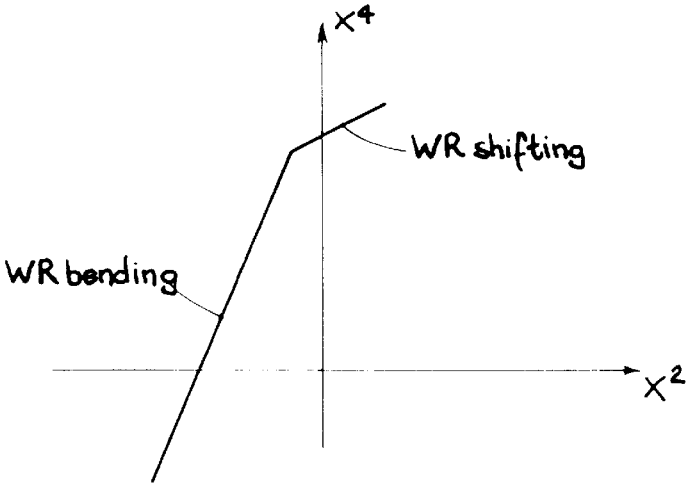
Figure 15:
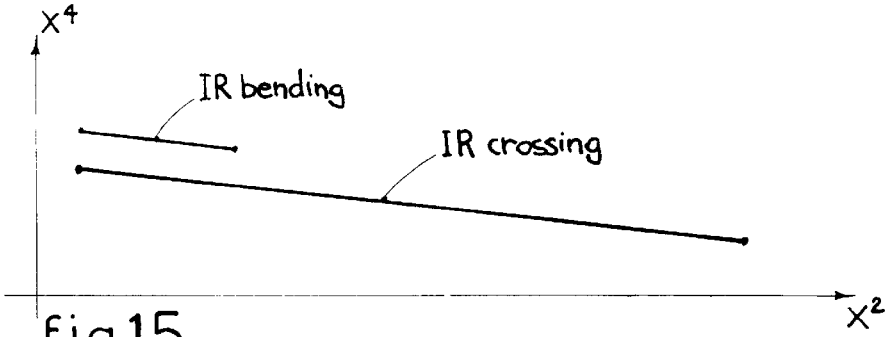
Figure 16:
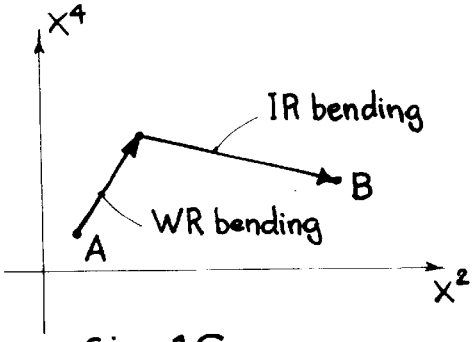
Figure 17:
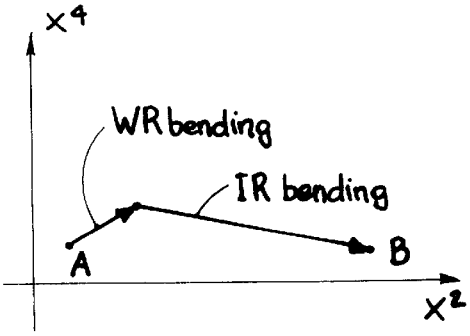
Figure 18:
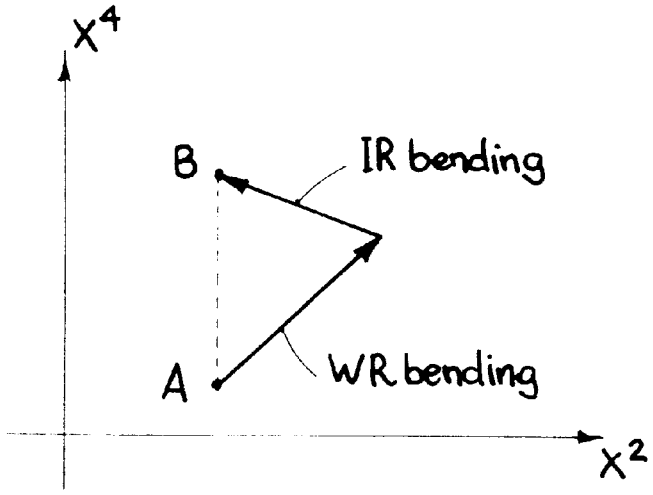
Figure 19:
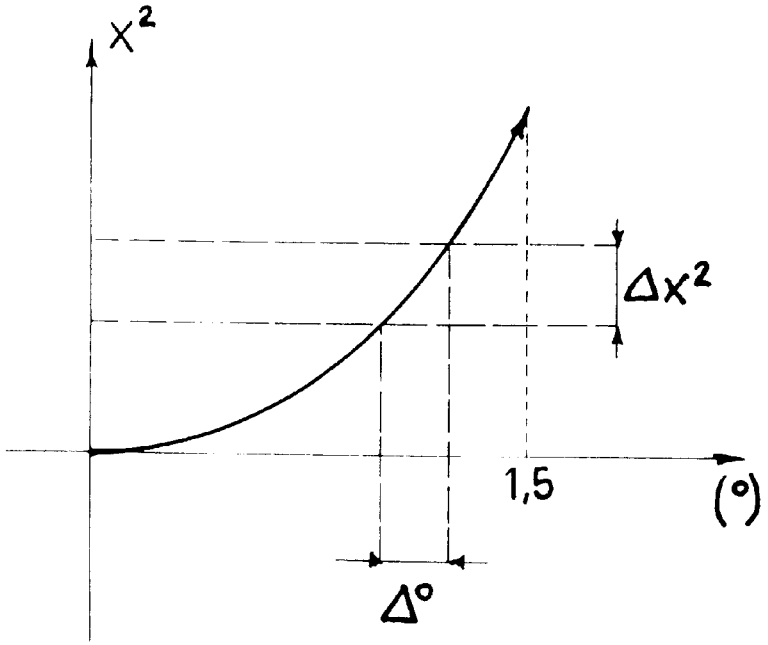

According to a simplified variant as shown in FIG. 2, a rolling stand 10 suitable to adopt a method according to the invention is of the so-called five-high type, and comprises only one intermediate roll 15*a* in the upper section. This five-high version allows to simplify the plant, due to the elimination of one intermediate roll and the relative crossing system, and a consequent simplification of the steps of changing the intermediate rolls 15*a*, 15*b*, at the same time ensuring a field of control which is in any case higher than in six-high stands of a conventional type.

It is obvious that modifications and additions may be made to the method to control the planarity of flat rolled products and the rolling stand 10 as described heretofore, but these shall remain within the field and scope thereof.

It is also obvious that, although the invention has been described with reference to specific examples, a skilled person in the art shall certainly be able to achieve many other equivalent variants thereof, but nevertheless these shall remain within the field and scope of this invention.

What is claimed is:

1. Method to control planarity of flat products rolled with a rolling stand (10) having a pair of working rolls (11*a*, 11*b*), a corresponding pair of back-up rolls (13*a*, 13*b*) and at least an intermediate roll (15*a*) placed between one of said working rolls (11*a*) and a corresponding back-up roll (13*b*), axial translation means (16) and first bending means (17) associated with at least one of said working rolls (11*a*) to translate it axially (WR shifting) and respectively bend it (WR bending), crossing means (19) associated with said intermediate roll (15*a*) to arrange it with its longitudinal axis (25*a*) inclined (IR crossing), or rotated on a horizontal plane, with respect to the longitudinal axes (21*a*, 21*b*, 23*a*, 23*b*) of said working rolls (11*a*, 11*b*) and of said back-up rolls (13*a*, 13*b*), and second bending means (20) associated with said intermediate roll (15*a*) to bend it with respect to the horizontal plane (IR bending), the method being characterised in that it provides a first static setting step, operating selectively at least on WR shifting and or IR crossing, and at least a second dynamic setting step, comprising, during rolling, operating selectively at least on WR bending and IR bending.

2. Method as in claim 1, characterised in that said WR shifting is preset according to edge-drop at sides of the rolled product without influencing a field of control of second order component ($x^2$) and a fourth order component ($x^4$).

3. Method as in claim 1, characterised in that said IR crossing is used to preset said intermediate roll (15*a*) and obtain a desired second order component ($x^2$).

4. Method as in claim 3, characrterised in that said IR crossing is obtained by means of a preset actuator (19), and further comprising carrying out IR crossing by means of said preset actuator (19) in rolling to change said second order component ($x^2$) if the WR bending and IR bending which control it dynamically are near saturation.

5. Method as in claim 1, characterised in that said WR bending and IR bending are dynamic controllers and can be actuated simultaneously to correct second order components ($x^2$) and fourth order components ($x^4$).

6. Method as in claim 1, characterised in that said WR bending and IR bending have substantially the same dynamic performance, with reply times of less than tenths of a second.

7. Method as in claim 1, characterised in that said WR bending and IR bending are both positive and negative.

8. Method as in claim 1, characterised in that the speed of said IR crossing is about 0.1°/sec, that the crossing angle is between about 0.20° and about 0.60°, and that therefore the crossing time is between about 2 secs and about 6 secs.

9. Method as in claim 3, wherein said IR crossing is obtained by means of a preset actuator.

* * * * *

UNITED STATES PATENT AND TRADEMARK OFFICE

CERTIFICATE OF CORRECTION

PATENT NO. : 6,338,262 B1
DATED : January 15, 2002
INVENTOR(S) : Donini et al.

It is certified that error appears in the above-identified patent and that said Letters Patent is hereby corrected as shown below:

Column 7,
Line 32, cancel beginning with "1. Method to control planarity of flat products rolled with" to and including "ing."

Column 8,
Line 11, and insert the following claim:

1. Method to control planarity of flat products rolled with a rolling stand (10) having a pair of working rolls (11a, 11b), a corresponding pair or back-up rolls (13a, 13b) and at least an intermediate roll (15a) placed between one of said working rolls (11a) and a corresponding back-up roll (13b), axial translation means (16) and first bending means (17) associated with at least one of said working rolls (11a) to translate it axially (WR shifting) and respectively bend it (WR bending), crossing means (19) associated with said intermediate roll (15a) to arrange it with its longitudinal axis (25a) inclined (IR crossing), or rotated on a horizontal plane, with respect to the longitudinal axes (21a, 21b, 23a, 23b) of said working rolls (11a, 11b) and of said back-up rolls (13a, 13b), and second bending means (20) associated with said intermediate roll (15a) to bend it with respect to the horizontal plane (IR bending), the method being characterised in that it provides a first static setting step, operating selectively at least on WR shifting and on IR crossing, and at least a second dynamic setting step, comprising, during rolling, operating selectively at least on WR bending and IR bending.

Signed and Sealed this

Thirtieth Day of April, 2002

*Attest:*

*Attesting Officer*

JAMES E. ROGAN
*Director of the United States Patent and Trademark Office*